US006709308B2

(12) United States Patent
Kaisio

(10) Patent No.: US 6,709,308 B2
(45) Date of Patent: Mar. 23, 2004

(54) FLYING DISC

(75) Inventor: Jukka Kaisio, Helsinki (FI)

(73) Assignee: Entercom Inc. Oy, Helsinki (FI)

( * ) Notice: Subject to any disclaimer, the term of this patent is extended or adjusted under 35 U.S.C. 154(b) by 0 days.

(21) Appl. No.: 10/297,042

(22) PCT Filed: Jun. 15, 2001

(86) PCT No.: PCT/FI01/00569

§ 371 (c)(1),
(2), (4) Date: Nov. 26, 2002

(87) PCT Pub. No.: WO01/97938

PCT Pub. Date: Dec. 27, 2001

(65) Prior Publication Data

US 2003/0119415 A1 Jun. 26, 2003

(30) Foreign Application Priority Data

Jun. 22, 2000 (FI) ..... 20001505

(51) Int. Cl.[7] ..... A63H 27/00

(52) U.S. Cl. ..... 446/46; 446/48; 446/236; 446/247

(58) Field of Search ..... 446/46, 47, 48, 446/236, 245, 247, 248, 250, 251, 252, 253, 254

(56) References Cited

U.S. PATENT DOCUMENTS 1,249,538 A * 12/1917 Soth ..... 446/245
1,321,836 A * 11/1919 McKenna ..... 446/253
1,613,331 A * 1/1927 Schreiner ..... 446/253
2,595,990 A * 5/1952 Steiner ..... 446/253
3,131,506 A * 5/1964 Fox ..... 446/253
3,295,251 A * 1/1967 Tomasello ..... 446/247
3,737,162 A * 6/1973 Wood ..... 446/253
3,935,663 A * 2/1976 Leibowitz ..... 446/48
4,955,842 A * 9/1990 Marcotti ..... 446/46
5,195,916 A * 3/1993 Her ..... 446/46
5,340,347 A * 8/1994 Yenerich ..... 446/48
5,951,353 A * 9/1999 Moore ..... 446/46

FOREIGN PATENT DOCUMENTS

WO WO 9409877 A1 * 5/1994 ..... A63H/27/104

* cited by examiner

*Primary Examiner*—Derris H. Banks
*Assistant Examiner*—Urszula M Cegielnik
(74) *Attorney, Agent, or Firm*—Rolf Fasth; Fasth Law Offices

(57) ABSTRACT

An improvement to a flying disc that returns to the user by means of a string using rotational energy in a manner of a yo-yo. The flying disc has a lower wing 1 that generates a lift, a smaller wing 2 and an axle 3. Between the wings 1,2 is a string 4 attached to the axle. The flying disc has at least one circular airfoil 11 and there are openings inside the area bound by its inner edge and the axle 3. Air currents from the direction of the flight that pass over and under the airfoil 11 are able to effectively mix through these openings. When slung with the string 4, the flying disc starts to rotate rapidly and flies away. It returns to the user when winding the string 4 back in the manner of a yo-yo.

8 Claims, 2 Drawing Sheets

FLYING DISC

PRIOR APPLICATIONS

This is a US national phase patent application that claims priority from PCT/FI01/00569, filed Jun. 15, 2001, that claims priority from Finnish Patent Application No. 20001505, filed Jun. 22, 2000.

FIELD OF THE INVENTION

This invention is an improvement to a flying disc which returns to the user by means of a string or corresponding elongated part, and uses rotational energy for the return flight in a way that resembles yo-yo motion. It may be used as a toy, for recreational purposes and as sporting equipment.

BACKGROUND AND SUMMARY OF THE INVENTION

The device known as a yo-yo exemplifies some of the existing technology that precedes the present invention. A yo-yo returns to the user by means of a string that first winds out and then in around an axle. The string forces the falling yo-yo to rotate and the primary source of this rotational energy is gravitational potential energy that is converted into rotational kinetic energy. The essential directions of its basic translational motion are vertical. It does not glide supported by air. Due to these characteristics the length of the yo-yo string is about 0.5–1 metre.

A traditional saucer-shaped flying disc is represented, for example, in U.S. Pat. No. 3,359,678, Headrick et al. This device rotates around its upright axis during translational flight generating lift. A great number of different forms of flying disc have been developed from the basic idea and many of these have been patented. It is appropriate to refer here to a ring-shaped flying disc represented, for example, in U.S. Pat. No. 4,560,358, and consisting of a ring-shaped airfoil with an uncovered inner area. These ring-shaped flying discs are somewhat more closely related to this invention than the traditional discs, in that the solutions to the problems of realising proper aerodynamic lift and low air-resistance are somewhat similar to the present invention. The traditional flying disc and its further developed versions are usually used by several people, who throw the disc to one another. Otherwise the lone user has to follow the disc and retrieve it each time after it has landed.

Goals and problems that somewhat more closely resemble those of the present invention, are sought and resolved in U.S. Pat. No. 3,802,117 by Engelhardt, and in patent publication WO 92/11913 by Tomberlin. A device according to Engelhardt's patent in its basic form consists a saucer-shaped flying disc, beneath which is a reel attached to a string. The user end of the string is fastened to a wand. The purpose of the device is to reel back to the person using it by means of the string. As the reel is positioned beneath the device and at a distance that is relatively remote from its centre of gravity, the device tends to dive or climb at steep angles when the string tightens during flight and the flight then fails. For this reason it is difficult to make the device rotate and move fast enough. The solution proposed in the publication for achieving flight stability is an additional weight added to the lower end of the reel, but this added weight actually creates new problems. A flying toy according to Tomberlin's publication has two identical rotary elements joined by an axle. The rotary elements are furnished with wings that create lift when the device rotates. This device creates lift expressly and exclusively by this rotary motion around its vertical axis. After each cast it has to be turned upside down so that the airfoil-wings are in a position to generate lift.

While the devices here described attempt at least partially to solve the same problems, they differ considerably from the present invention in respect of their solutions. A type of flying disc that is more of a starting point for the present invention and its improvements is represented in Finnish patent no. 93426, throw and fly device by Kaisio and Kukkonen. A flying disc according to this patent consists of a convexo-concave base-part resembling a traditional flying disc with a top-mounted flange at the end of a short axle. There is a space for the string between the flange and the base-part. This space is about as wide as the diameter of the string. The device flies supported by air and rotates around its vertical axis. The energy conserved in rotary motion returns the device to its user by means of a string in a way that resembles the function of the yo-yo.

An important problem of devices configured according to Pat. No. 93426 FI is caused by this very narrow space for the string, which is only the diameter of the string or at most 1–2 diameters. This leads to a situation where the length of string for a single winding around the axle changes considerably during flight. This means that the angular momentum of the device decreases as it approaches its user. At the same time kinetic energy of rotation is also consumed in correcting the flight path and in overcoming air-resistance. The flight speed therefore decreases and there is a practical problem that flight often stalls before the return is complete. Another trouble is that the string tends to tangle into the proposed narrow space in a way that is often difficult to disentangle and quite frustrating to the user.

Considerable improvements are achieved by a flying disc configured according to the present invention. In particular, the air-resistance is lower and the aerodynamic properties are more favourable than those of Pat. no. 93426 FI and other predecessors. The invention is based on the fact that air-currents flowing over and under the translationally moving circular airfoil that forms part of this yo-yo returning flying disc, are able to mix through openings in the area bounded by the inner edge of the circular airfoil and the axle. The present invention constitutes a breakthrough for more balanced flight and lower air-resistance. These have hitherto remained major problems in all known solutions for flying discs employing some kind of string arrangement and yo-yo function. There are also other benefits.

A yo-yo returning flying disc configured according to the present invention can be constructed to be lighter in proportion to the aerodynamic lift which it generates. This enables it to glide at lower translational speeds. It returns more easily than its predecessors on longer strings. The improved flight properties also make it easier for a beginner to fly the device with a relatively short string. Improved aerodynamic properties also make its flight more stable in windy conditions.

Using a slinging technique and a lighter construction according to the present invention the flying disc may be accelerated to a considerably faster rate of rotation. In this rotation the kinetic energy increases in direct proportion to the square of the speed. It may thus be considered capable of storing more energy in the form of rotational movement than earlier versions. This increased rotational kinetic energy provides enhanced stability at the turning point where the string tugs on the flying disc and it reverses its direction of flight. The location of the string vertically close to the centre of gravity also favourably influences stability of the flying disc at this turning point.

One further benefit of the lighter construction is that the impact of the flying disc is reduced in the event that it accidentally collides with the user. The user may be relaxed about flying the device and need not worry about being hit by some rapidly flying heavy object if he fails to catch it.

Compared to current technology a construction according to the present invention brings about these and certain other improvements. The present invention is characterised by the claims appended hereto.

BRIEF DESCRIPTION OF DRAWINGS

The following description refers to the accompanying illustrations, in which.

DETAILED DESCRIPTION

Figure 1:
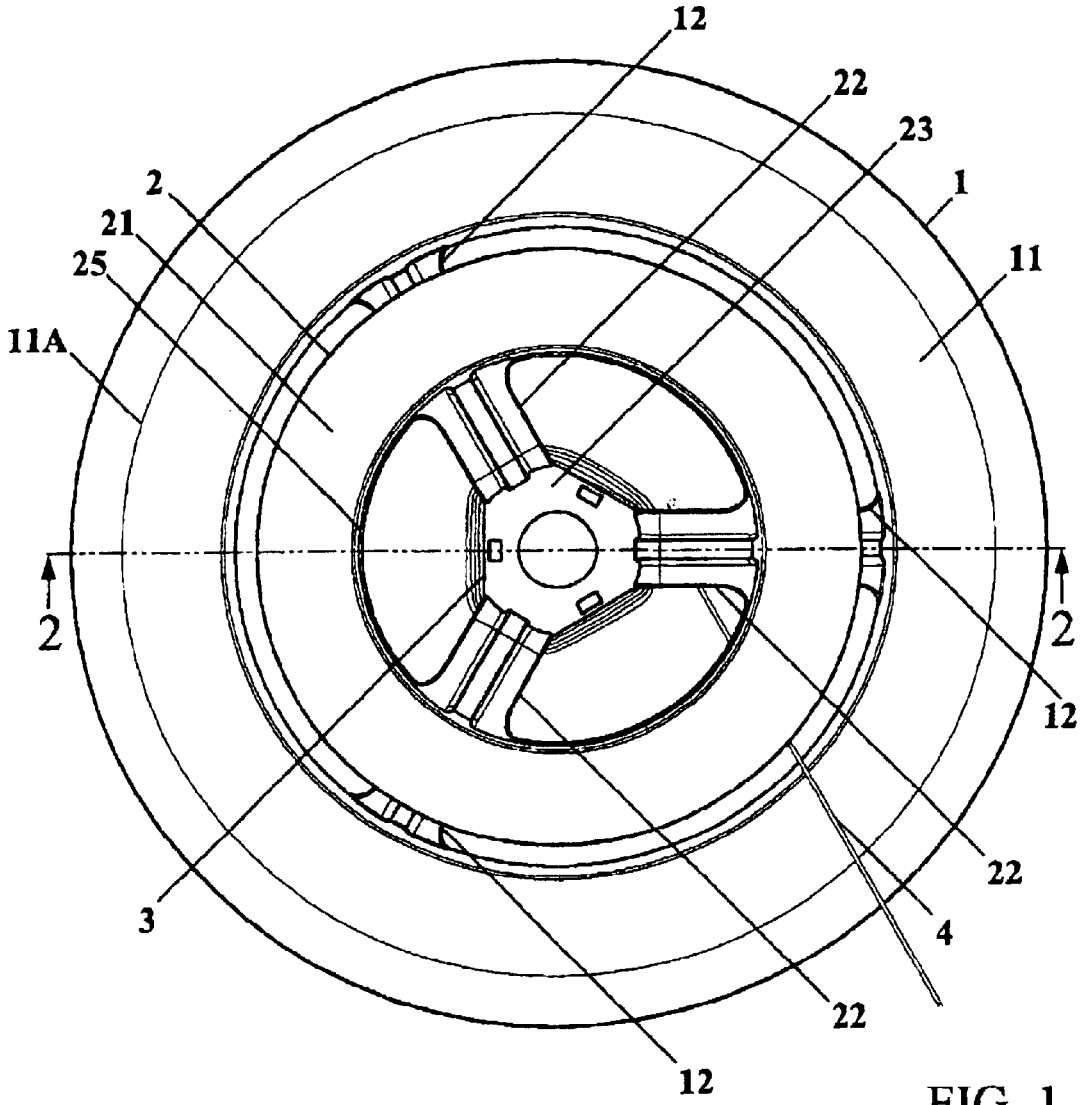
FIG. 1 is a top view of one possible embodiment of the present invention.
Figure 2:
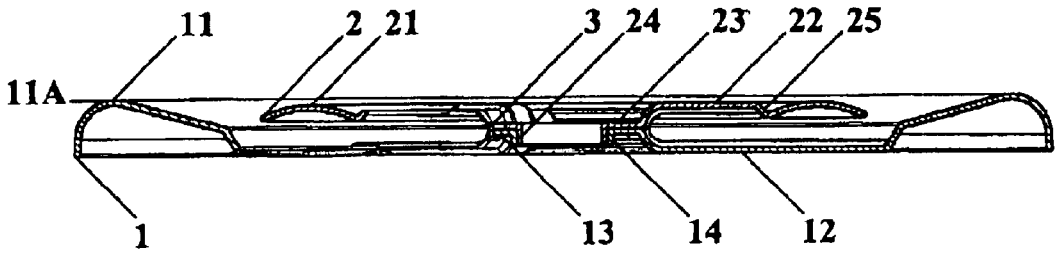
FIG. 2 is a cross-sectional transverse view along the line A—A of the embodiment illustrated in FIG. 1 without the string.

In FIGS. 1 and 2 there is a flying disc constructed according to the present invention, which includes a lower wing (1) and an upper wing (2) with a space between these for a string (4) to be wound. The term "string" is used here in a broad sense to include any elongated part of flexible material, for example strings, braids, bands, cords and lines. The string (4) is attached with a loosely-fitting loop around the axle (3) that is formed by centre hub area (13) of the lower wing (1) and the centre hub area (23) of the upper wing (2). The string (4) may also be attached by some other method or means with the purpose of remaining attached during the entire flight. A loosely-fitting loop is beneficial in that it allows the rotating movement to continue smoothly at the turning point without interruption. It is emphasised that the width of free space for winding the string (4) is significantly greater than the diameter of the string that is used. In the illustrated embodiment it is of the order of 5–20 times this diameter, depending on the string that is used. Therefore the angular momentum of the flying disc and the length of string per single revolution is sufficiently uniform for practical purposes throughout the entire flight-path.

In this embodiment the length of the string (4) is usually of the order of 3 to 20 meters. A thinner string is chosen for greater lengths. To fly a flying disc according to the present invention the string (4) is wound around the axle-arrangement (3) described. The other end of the string (4) is usually attached to the user's right hand forefinger by a loop or some other means, or to the left hand forefinger if the user is left-handed. It may also be attached, for example, to some other finger or to the wrist. The flying disc is held in the hand and raised to a starting position—usually level with the horizontal. The grip is released and then immediately, before the disc has time to fall, the arm is accelerated in a brisk swing away from the flying disc. The spool formed by the lower wing (1) and the upper wing (2) is accelerated into a rapid rotation by the string (4) pulling it. At the same time the device slings into flight. When the string has entirely unwound the flying disc reverses its direction of flight and starts to return. The string (4) stretches somewhat, opposing the translational motion, and the disc reverses its direction smoothly. The speed of translational motion is essentially maintained when the direction is reversed. At the same time the flying disc continues its rapid rotation and therefore the string (4) now winds back in around the axle (3) and the disc speeds back to the user. When it comes close the user can catch it. After a successful flight the device is immediately ready to be slung for a new flight in the manner described above.

Figure 3:
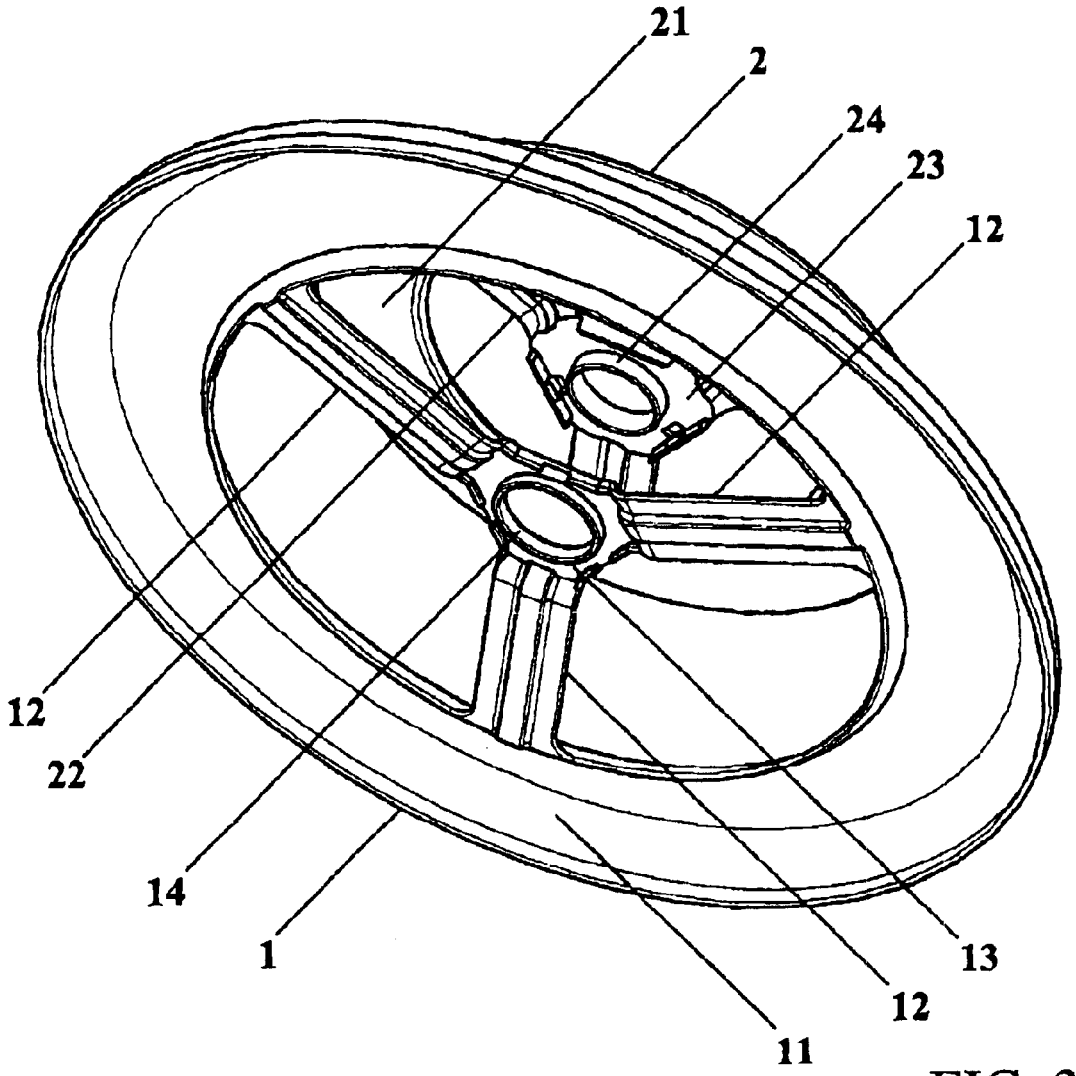
FIG. 3 is the embodiment illustrated in FIGS. 1 and 2, which has been dismembered with the parts—the upper and lower wing—viewed from below at an oblique angle.

FIG. 3 illustrates the lower wing (1) and the upper wing (2) apart before they are fastened together. It may also be possible to manufacture these wings for a flying disc according to the present invention as a single piece, or the wings may also naturally be constructed with more than two pieces. In this illustrated embodiment fastening aids can be seen on the central hub area (23) of the upper wing (2). These fit into forms of the central hub area (13) of the lower wing (1), which facilitate the fastening with a so-called snap-fit method. In this method the parts are fastened by pressing them together so that the convenient forms interlock. An upright cylindrical surface (14) of the central area (13) of the lower wing (1) and the corresponding upright cylindrical surface (24) of the upper wing (2) enable easier adjustment of the parts when they are assembled. These forms are also related to the injection moulding process used in manufacturing the parts. The lower wing (1) and the upper wing (2) are injection moulded in a suitable thermoplastic such as polypropylene. Other materials and manufacturing methods may also be applied without departing from the spirit of the invention.

With the present invention an aerodynamically favourable effect is achieved by forming openings in the surfaces of the disc that are positioned according to the invention. In the embodiment described there are openings not only on the lower wing (1), but also on the upper wing (2). The aerodynamic effect of these openings is further described in the following paragraphs. One subsidiary advantage of these openings is to enable a reduction in the weight of the construction. This derives from the fact that traditional injection moulding technology imposes limits on the minimum thickness of plastic parts. In this method the hot thermoplastic is injected in liquid form into a metal mould and then solidified at lower temperature. The thickness of the wings (1) and (2) must exceed about 1 millimetre because in practice plastic material in liquid form does not flow in channels that are too narrow. Thus within certain limits the minimum weight of the parts depends quite directly in practice on the surface area.

The lower wing (1) includes a circular airfoil (11) that encircles its vertical axis. The cross section of the airfoil (11) bends in a curve, thereby generating upward lift in the same way as an aeroplane wing when moving translationally through the air. Air currents pass faster over the airfoil than below it, and the resulting difference in air pressure generates the lift. As shown in FIG. 2 the upper surface of the airfoil (11), that is cross sectioned toward the vertical axis of the flying disc, starts from the lowest level and bends upwards following a somewhat circular path before sloping down to lower level following a line that is tangential to the said circle. This line is at a 15° angle to a line perpendicular to the vertical axis of the flying disc. At essentially the lowest level of the flying disc one of the wing spokes (12) can be seen connected to the circular airfoil (11). The material thickness over the entire profile is quite uniform in this embodiment that is adapted for manufacture by injection moulding. Naturally without departing the scope of this invention the airfoil (11) could be manufactured in many different ways and of many possible materials. For example it could be made of foam plastic and the material thickness of the profile could vary at different distances from the vertical axis. Many shapes of profile in addition to those described can be applied, having regard to the laws of aerodynamics. The wing spokes (12) connect the circular airfoil (11) to the central hub area (13). In the depicted embodiment there are three wing spokes (12). The airfoil (11) is the only significant lift-producing element in the lower wing (1). A considerable part of the area between inner limits of the airfoil (11) and the vertical axis is open to air currents, in other words there are openings between the wing spokes (12). In the depicted embodiment these comprise about 75 percent of the total area described. These openings enabling free airflow through the lower wing (1) are of the utmost importance, as they enable the air currents passing over and under the airfoil (11) to meet and mix within the area of the airfoil (11), which considerably balances and enhances flight performance. It worth repeating that besides this, such a use of openings also considerably reduces the surface area needed to generate a certain lift effect.

The upper surface of the circular airfoil (21) of the upper wing (2), that is cross sectioned toward the vertical axis in the embodiment depicted, first follows a circular path and then near the inner edge slants steeply upwards in the circle fold (25) of the airfoil (21). The slanting surface extends up to more or less the greatest height level of the upper surface of the circular airfoil (21), and is joined to the upper wing hub area (23) by means of three wing spokes (22). The circle fold (25) prevents the string (4) from getting tangled in the wing spokes (22). This generates some negative lift in translational movement. In the depicted embodiment of the present invention the circular airfoil (11) of the lower wing (1) generates the main lift for the flying disc.

Figure 4:
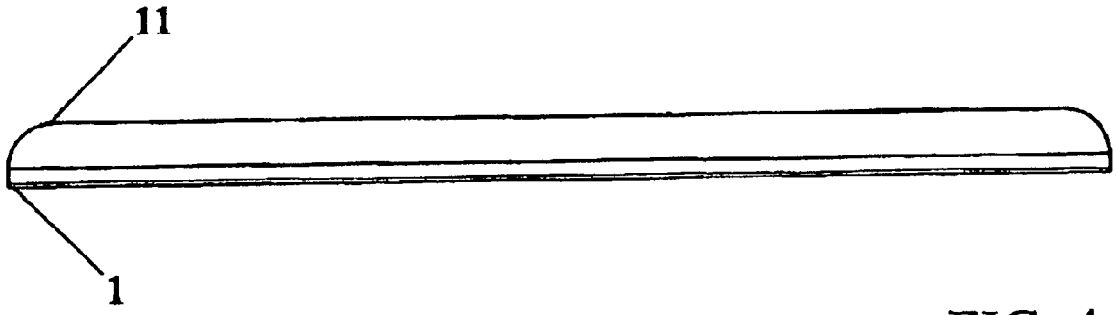
FIG. 4 is a side view of the embodiment illustrated in FIGS. 1, 2 and 3 without the string.

By a construction according to the present invention the axle (3) and the upper wing (2) may be fitted into the hollow inner area of the lower wing (1) so that in the transverse view of this particular embodiment shown in FIG. 4 the upper wing (2) is vertically entirely between the uppermost and lowermost points of the airfoil (11). In other words it is hidden from view behind the profile of the circular airfoil (11).

It should be noted that within the scope of this invention but differing from the depicted embodiment, the upper wing (2) may well be constructed with small openings or with no openings at all. It is quite sufficient for the purpose of this invention that there is enough open surface in the inner area of the circular airfoil (11) of the lower wing (1) to enable the air currents passing over and under the airfoil (11) to mix effectively through these openings. Compared to the current technology of flying discs that return with a yo-yo like function, the present invention considerably reduces air-resistance and achieves a breakthrough both in glide-performance and in flight-stability.

It must be understood that the invention is capable of considerable variation and modification without departing from the spirit of the invention. We therefore do not wish to be restricted to the precise details of the constructions set out herein, but desire to avail ourselves of such modifications as fall within the scope of the appended claims.

I claim:

1. A returning flying disc comprising a lower wing [1], an upper wing [2] of smaller diameter mounted axially, and between these an axle [3] connecting the wings perpendicularly with a clearance between them, and a string [4] or corresponding part that is attached to the axle [3] and that can wind around this axle so that when allowed to fly the flying disc returns as the string winds back into a free space between the wings, characterized in that the lower wing [1] has at least one circular airfoil [11] generating lift on horizontal flight, and that there are openings within an area bounded by an inner edge of the circular airfoil [11] and the axle [3], so that the air-currents from a direction of flight that pass over and under the airfoil [11] are able to mix through these openings, axle (3) being disposed below an uppermost point **(11*a*) of the airfoil (11)**.

2. A flying disc according to claim 1, characterized in that the upper wing [2] and the axle [3], when viewed from a side, lie substantially between planes that are projected by revolving around a vertical axis those lines perpendicular to it that pass through a uppermost and the lowermost points of the airfoil [11].

3. A returning flying disc comprising a lower wing [1], an upper wing [2] of smaller diameter mounted axially, and between these an axle [3] connecting the wings perpendicularly with a clearance between them, and a string [4] or corresponding part that is attached to the axle [3] and that can wind around this axle so that when allowed to fly the flying disc returns as the string winds back into a free space between the wings, characterized in that the lower wing [1] has at least one circular airfoil [11] generating lift on horizontal flight, and that there are openings within an area bounded by an inner edge of the circular airfoil [11] and the axle [3], so that air-currents from the direction of flight that pass over and under the airfoil [11] are able to mix through these openings the upper wing [2] having at least one circular airfoil [21], and that there are openings within the area bounded by the inner edge of the circular airfoil [21] and the axle [3], so that air-currents from the direction of flight that pass over and under the airfoil [21] are able to mix through these openings.

4. A flying disc according to claim 1, characterized in that the airfoil [11] of the lower wing [1] is joined to the axle [3] by two or more wing spokes [12] with openings between them.

5. A flying disc according to claim 3, characterized in that the airfoil [21] of the upper wing [2] is joined to the axle [3] by two or more wing spokes [22] with openings between them.

6. A flying disc according to claim 5, characterized in that the wing spokes [12] and [22] bend in a curve towards hub areas [13] and [23], and that parts of the said spokes that are nearest to a vertical axis of the flying disc and the hub areas [13] and [23] form the axle [3].

7. A flying disc according to claim 1, characterized in that the upper surface of hub area [13] of the lower wing [1] and the bottom surface of the hub area [23] of the upper wing [2] are main joining area of the said wings.

8. A flying disc according to claim 1, characterized in that an area of the openings is at least 50% of the whole area bounded by the inner edge of the circular airfoil [11] and the axle [3].

* * * * *